US006604631B2

(12) United States Patent
Evans et al.

(10) Patent No.: US 6,604,631 B2
(45) Date of Patent: Aug. 12, 2003

(54) EXPANDABLE ACCESSORY BOX AND PACKAGING SYSTEM FOR PACKAGING ELECTRONIC SYSTEMS

(75) Inventors: Timothy M. Evans, Austin, TX (US); David M. Combs, Pflugerville, TX (US)

(73) Assignee: Dell Products, L.P., Round Rock, TX (US)

( * ) Notice: Subject to any disclaimer, the term of this patent is extended or adjusted under 35 U.S.C. 154(b) by 2 days.

(21) Appl. No.: 09/900,998

(22) Filed: Jul. 9, 2001

(65) Prior Publication Data

US 2003/0006165 A1 Jan. 9, 2003

(51) Int. Cl.[7] ..... B65D 85/00
(52) U.S. Cl. ..... 206/320; 206/767
(58) Field of Search ..... 206/320, 223, 206/576, 774, 525, 591, 45.25, 45.26, 45.27, 767; 229/124, 126, 128, 131, 131.1, 160.2, 163, 149, 153, 154

(56) References Cited

U.S. PATENT DOCUMENTS

| | | | | | |
|---|---|---|---|---|---|
| 325,114 | A | * | 8/1885 | Jaeger | 229/160.1 |
| 1,765,084 | A | * | 6/1930 | Locke, Jr. | 229/117.12 |
| 2,553,157 | A | * | 5/1951 | Worfford | 43/66 |
| 2,771,232 | A | * | 11/1956 | Reed | 294/159 |
| 3,306,520 | A | * | 2/1967 | Allard | 229/149 |
| 4,245,773 | A | * | 1/1981 | Stollberg | 206/509 |
| 4,848,648 | A | | 7/1989 | Eisman | |
| 5,133,459 | A | | 7/1992 | Genix | |
| 5,295,580 | A | | 3/1994 | Hicks | |
| 5,520,284 | A | * | 5/1996 | Gray | 206/509 |
| 5,636,746 | A | | 6/1997 | McQueeny | |
| 5,979,749 | A | * | 11/1999 | Bozich | 229/235 |
| 6,012,630 | A | | 1/2000 | Block | |
| 6,036,044 | A | | 3/2000 | Parker et al. | |

* cited by examiner

*Primary Examiner*—Shian Luong
(74) *Attorney, Agent, or Firm*—Russell D. Culbertson; Shaffer & Culbertson, L.L.P.

(57) ABSTRACT

An expandable accessory box (10) may be configured in either a retracted configuration or an expanded configuration. In the retracted configuration, the expandable accessory box (10) may be used in connection with a first primary box (51) to accommodate both the base piece of equipment or base component, such as a portable computer for example, and a first volume (A) of accessories to be shipped together with the base component. The first primary box (51) snugly receives both the base component and the accessory box (10) in the retracted configuration. However, the accessory box (10) may be placed in the expanded configuration and used with a second, larger primary box (61) to contain both the base component, the first volume (A) of accessories, and an additional volume (E) of accessories. The second primary box (61) is sized to snugly receive the base component and the accessory box (10) in its expanded configuration.

13 Claims, 7 Drawing Sheets

EXPANDABLE ACCESSORY BOX AND PACKAGING SYSTEM FOR PACKAGING ELECTRONIC SYSTEMS

TECHNICAL FIELD OF THE INVENTION

This invention relates to product shipping cartons. More particularly, the invention relates to a shipping carton system which provides additional capacity for shipping accessories along with a related main or base product. The invention encompasses an expandable accessory box and a packaging system which utilizes the expandable box along with a primary box. The invention further encompasses a method for accommodating an increased volume of accessories to be packaged together and shipped along with a related product, especially a computer system.

BACKGROUND OF THE INVENTION

Many types of products may be customized for a particular consumer and then shipped directly to the consumer. For example, portable computers may be shipped with a number of different accessories such as power supplies, chargers, additional drives, and various software media along with hard copy manuals and documentation. The highly customizable nature of these types of products combined with the practice of shipping products directly to the consumer creates problems in the design of shipping cartons or packages for the products. Ideally, shipping cartons should be as compact as possible in order to save shipping costs and the cost of the carton itself. Also, minimizing shipping carton size is desirable for environmental reasons.

One solution to the shipping carton issue for highly customizable products is to design a single carton or box large enough to accommodate any configuration in which the product may be shipped. This solution is wasteful of the material used for the one-size-fits-all box, and wasteful of the material required inside the box for stabilizing the various configurations which may be shipped.

Another solution to the packaging problem is to have a different shipping carton for each different product configuration that could be ordered. This solution, however, is expensive both in terms of the number of cartons which must be designed and in terms of the number of cartons which must be held in inventory. Also, it may be difficult to match the appropriate shipping carton with a particular product configuration for the product packaging step.

Yet another solution for packaging highly customizable products for shipping is to use one small carton for the base product and then completely separate cartons for each optional item which may be purchased along with the base product. However, this solution raises the problem of shipping the resulting multiple cartons to the purchaser and may increase shipping costs.

SUMMARY OF THE INVENTION

It is an object of the invention to provide an accessory box capable of conveniently accommodating different volumes of accessories to be shipped together with a base piece of equipment. Another object of the invention is to provide a packaging system and packaging method for accommodating increased volumes of accessories to be shipped together with a base piece of equipment.

In order to accomplish these objects, the invention includes an expandable accessory box that may be configured in either a retracted configuration or an expanded configuration. In the retracted configuration, the expandable accessory box may be used in connection with a first primary box to accommodate both the base piece of equipment (base component), such as a portable computer, and a first volume of accessories to be shipped together with the base component. The first primary box snugly receives both the base component and the accessory box in the retracted configuration. Alternatively, the accessory box according to the invention may be placed in the expanded configuration and used with a second, larger primary box to contain both the base component, the first volume of accessories, and an additional volume of accessories. The second primary box is sized to snugly receive the base component and the accessory box in its expanded configuration. The expandable accessory box together with the two different primary boxes make up the packaging system according to the invention.

As used in this disclosure and the accompanying claims, the term "volume" when referring to accessories means a quantity of the accessories and related material, and not necessarily the absolute value for the space occupied by the accessories and related materials. In particular, the "first volume of accessories" refers to a quantity of accessories and related materials that will properly fit in a first accessory space or volume defined by the present expandable accessory box in its retracted configuration. The "additional volume of accessories" likewise refers to a quantity of accessories and related material that will properly fit in an additional accessory space or volume which will be described further below.

The accessory box according to the invention includes a first side and an extension side along with a number of extension members. These extension members may placed in either a retracted position corresponding to the retracted configuration of the accessory box, or an extended position corresponding to the expanded configuration of the accessory box. The space between the two sides of the accessory box define the first accessory volume. However, when the extension members are positioned in their extended position, they extend outwardly from the extension side of the accessory box and function to space the remainder of the box from a wall of the primary box in which the accessory box may be received. This additional space between the extension side of the accessory box and the wall of the primary box in which it is received represents the additional accessory volume.

It is important that the extension members remain in the extended position both while filling primary and accessory boxes and when handling the filled primary and accessory boxes during shipping. Thus, each extension member preferably includes a first retainer device which helps hold the respective extension member in the extended position as desired. Each first retainer device may cooperate with a respective additional retainer device on the primary box in which the expanded accessory box is received in order to hold the extension members in the extended position.

The method of packaging according to the invention includes maintaining stocks of the first primary box, the larger second primary box, and the expandable accessory box. If it is determined that the amount or nature of accessories to the shipped with a base component requires a space larger than the first accessory volume defined by the volume between the first side and extension side of the accessory box, the method includes selecting one of the second primary boxes for shipping the base component and accessories. The method further includes placing the accessory box in its expanded configuration and securing the accessory box in the second primary box. In the secured position, the first retainer device associated with each extension member cooperates with additional retainer devices on the second primary box to hold the accessory box in its expanded configuration.

These and other objects, advantages, and features of the invention will be apparent from the following description of preferred embodiments, considered along with the accompanying drawings.

DESCRIPTION OF THE PREFERRED EMBODIMENTS

Figure 1:
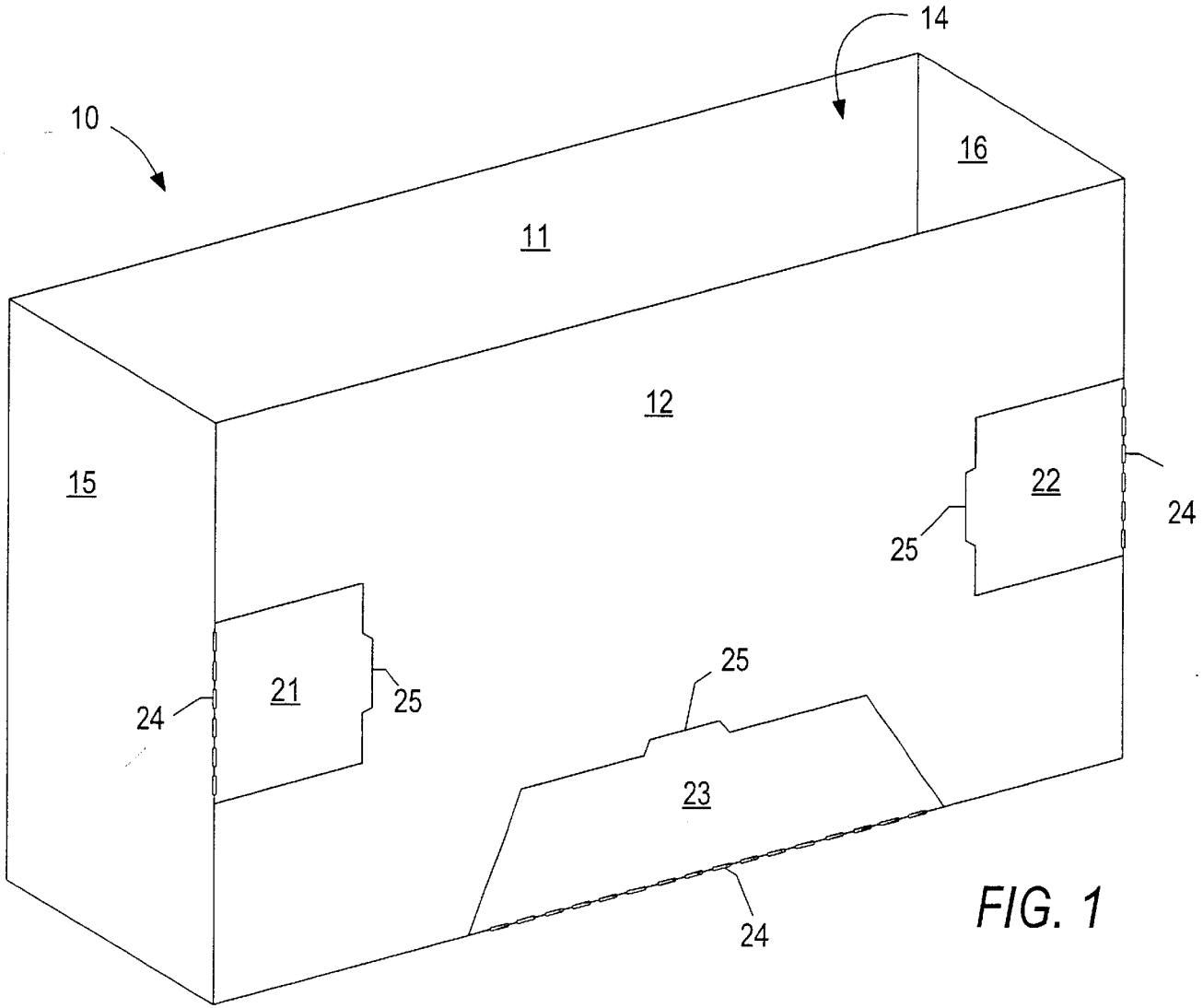
FIG. 1 is a perspective view of an accessory box embodying the principles of the invention in the retracted configuration.
Figure 2:
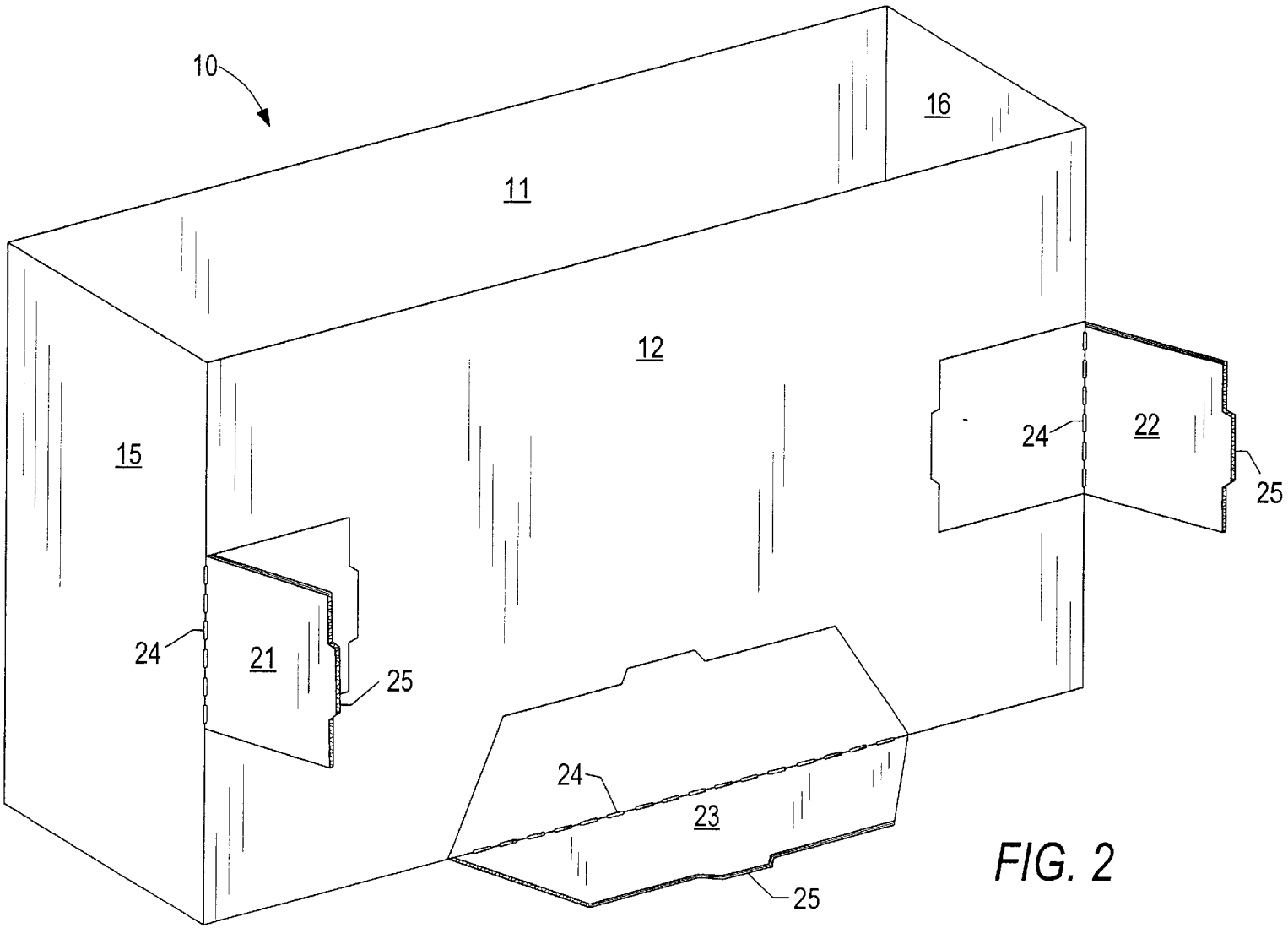
FIG. 2 is a perspective view similar to FIG. 1 but with the accessory box in the expanded configuration.
Figure 4:
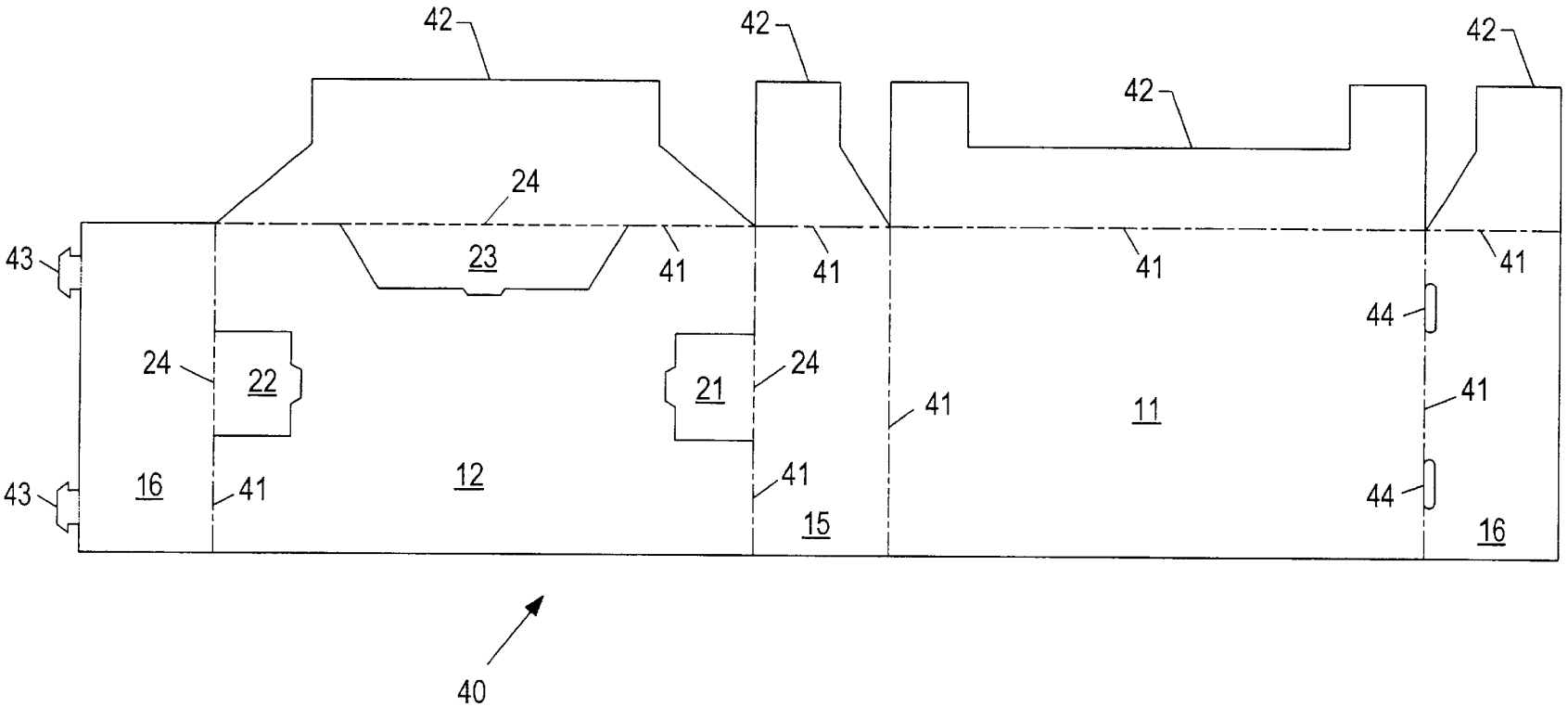
FIG. 4 is a top view of a material blank that may be used to form the expandable accessory box shown in FIGS. 1 and 2.

Referring first to FIGS. 1 and 2, an expandable accessory box 10 according to the invention includes a first side 11 and an extension side 12. The illustrated form of the accessory box 10 includes an open top 14, although it will be appreciated that the box may include a suitable lid for covering the top opening. Accessory box 10 also includes a first end 15 and a second end 16 connecting the first and extension sides 11 and 12, respectively. It will be appreciated that accessory box 10 also includes a bottom which is not shown in the perspective of FIGS. 1 and 2. Elements which make up the bottom of accessory box 10 are shown in FIG. 4 and will be described below with reference to that figure.

FIGS. 1 and 2 also show three extension members associated with accessory box 10. In the illustrated form of the invention the extension members include a first end extension member 21, a second end extension member 22, and a bottom extension member 23. Each of these extension members is shown in its retracted position in FIG. 1 and in its extended position in FIG. 2. In this preferred form of the invention, each extension member is cut from the material making up extension side 12 of accessory box 10. The accessory box material is scored in a suitable fashion at the base of each extension member. The score lines are indicated in the figures at reference number 24. These score lines at the base of the extension members allow the extension members to be more easily pivoted between the retracted position shown in FIG. 1 and the extended position shown in FIG. 2. The illustrated scoring is accomplished by making spaced apart cuts in the accessory box material along the line making the desired pivot axis for the respective extension member.

Figure 6:
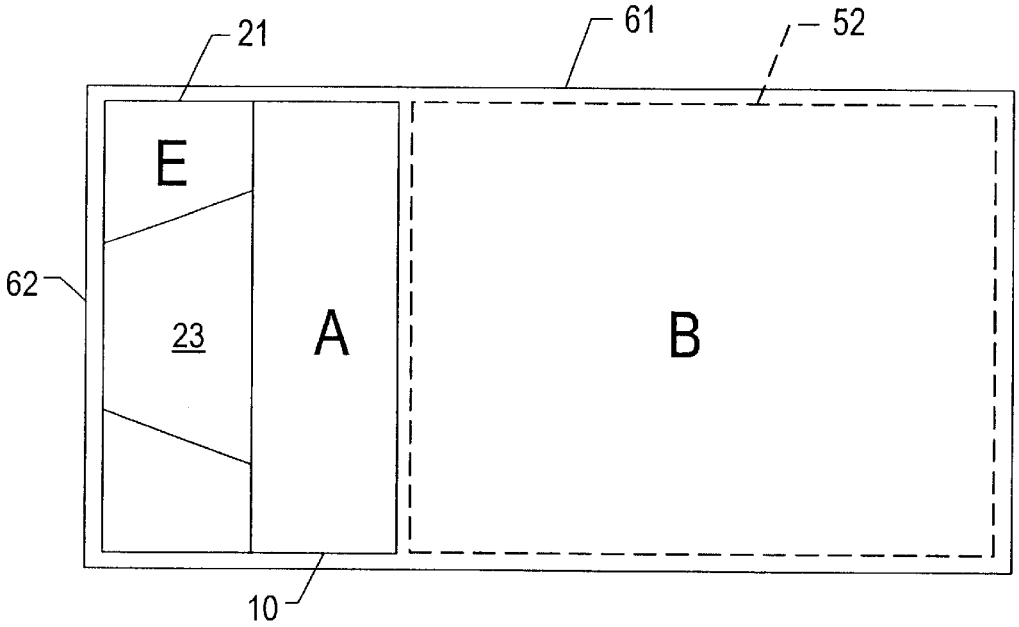
FIG. 6 is a diagrammatic top view similar to FIG. 5 but showing the accessory box in the expanded configuration within one of the second primary boxes.
Figure 7:
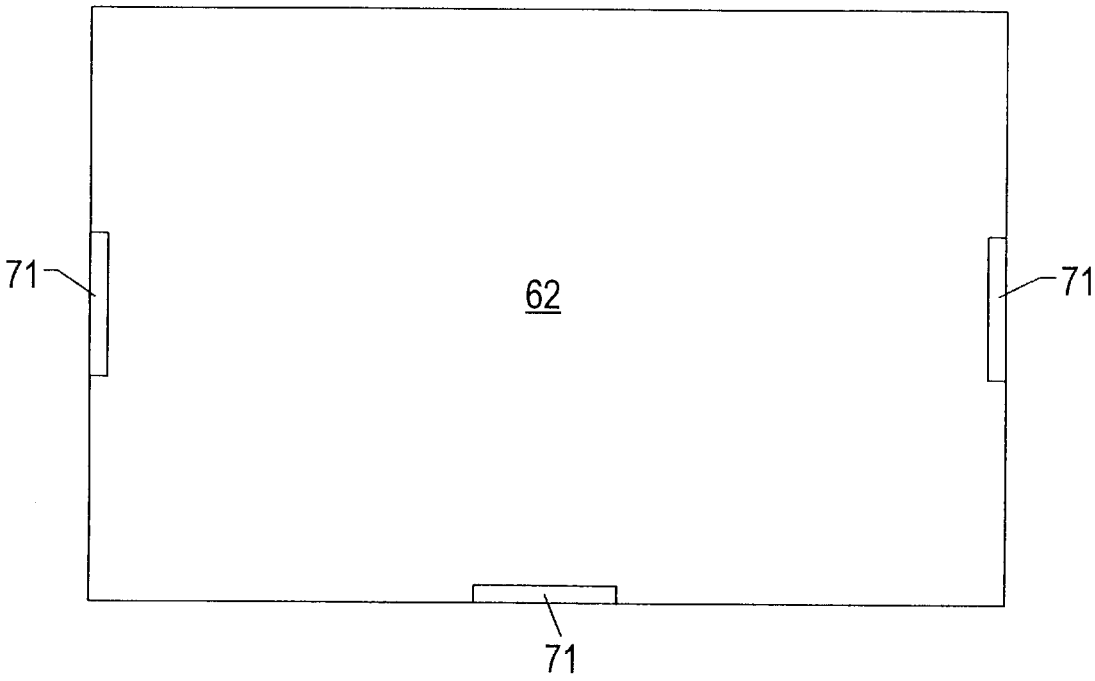
FIG. 7 is an end view of one of the second primary boxes, showing particularly the retainer slots in the second primary box.

FIGS. 1 and 2 also show first retainer devices 25 preferably included with each extension member 21, 22, and 23. In this form of the invention, each first retainer device 25 comprises a tab located at the distal end of the respective extension member. Each tab cooperates with a corresponding second retainer device on a primary box to help hold the extension member in the desired extended position shown in FIG. 2. The primary box and second retainer devices are illustrated in FIGS. 6 and 7 and will be described further with reference to those figures.

Figure 3:
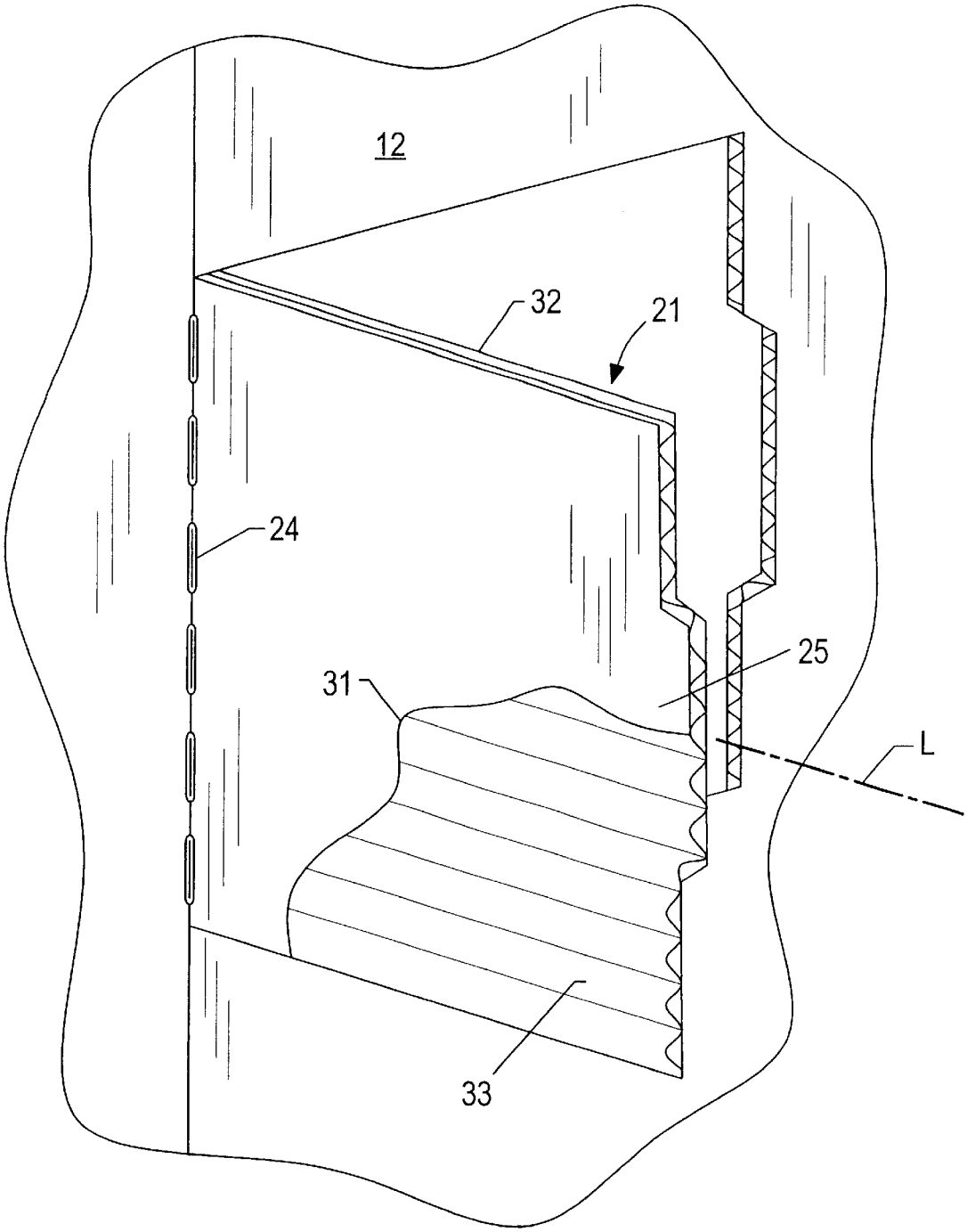
FIG. 3 is a partial perspective view showing one of the extension members according to the invention, partially broken away to show the flutes of the corrugated board material from which the extension member is formed.

Referring now to FIG. 3, the preferred corrugated paperboard extension members have a first side web 31, a second side web 32, and flutes 33 sandwiched between the two material webs. The flutes 33 of the corrugated board material extend generally parallel to the longitudinal axis L of the respective extension member. At least some of the extension members included in accessory box 10 have flutes oriented as shown in FIG. 3 in order to provide sufficient strength along the longitudinal axis of the respective extension member as will be discussed further below. In the embodiment of the invention shown in FIGS. 1 and 2 for example, end extension members 21 and 22 each have flutes oriented as shown in FIG. 3.

In the preferred form of the invention, accessory box 10 is formed from a single blank of corrugated board material. FIG. 4 shows a suitable blank 40 stamped or otherwise cut from a single sheet of corrugated board material. Blank 40 may then be folded along fold lines shown at reference number 41 into the configuration of accessory box 10 shown in FIGS. 1 and 2. In FIG. 4, first end extension member 21, second end extension member 22, and bottom extension member 23 are each shown cut from material which will form extension side 12 of accessory box 10. Blank 40 also includes material to form first end 15, second end 16, and first side 11. The elements shown at 42 in FIG. 4 cooperate to form the bottom of accessory box 10. Tabs 43 cooperate with slots 44 to hold the material together in the form of accessory box 10 shown in FIGS. 1 and 2.

It will be appreciated that numerous variations are possible in the preferred form of the invention illustrated in FIGS. 1 through 4. For example, accessory box 10 could be formed from any suitable material, and is not limited to corrugated paperboard. Also, extension members 21, 22, and 23 need not be integrally formed with the remainder of the accessory box elements. Rather, the extension members may be separately formed and connected via suitable means to the remainder of the accessory box. Yet another variation relates to the first retainer devices 25. Although a simple tab retainer device 25 is shown in FIGS. 1 through 4 for each extension member, other types of retainer devices may be employed within the scope of the following claims. For example, the first retainer device may alternatively comprise a brace that holds the respective extension member in the extended position. These and other variations within the scope of the following claims will be apparent to those skilled in the field of packaging and packaging systems.

Figure 5:
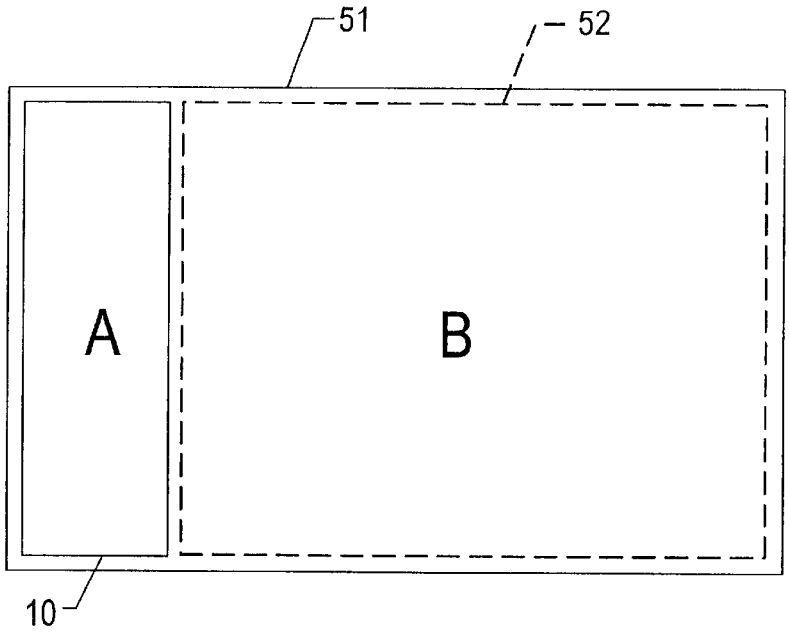
FIG. 5 is a diagrammatic top view showing the present accessory box used in its retracted configuration within one of the first primary boxes.

The use of accessory box 10 and the other elements of the present packaging system may now be described with reference to FIGS. 5 and 6. FIG. 5 shows accessory box 10 in its retracted configuration (as shown in FIG. 1) within a first primary box 51. Primary box 51 includes room for snugly receiving both the accessory box 10 and a base component (not shown) in an area B shown by dashed box 52. The base component held in area B may comprise any type of component with which various accessories may be shipped. The present invention has particular application to packaging portable and other personal computer systems. It will be appreciated that in any event, the base component will commonly be held in protective end caps or a protective cradle within area B. Thus, area B must be sized to accommodate both the base component and its associated protective packaging.

The volume in FIG. 5 between first side 11 and extension side 12 of accessory box 10 defines a first or regular volume A for accessories to be shipped with the base component. Accessory box 10 may be sized such that this first volume A is sufficient for receiving a standard set of accessories which is commonly shipped with the base component. Spacers (not shown) within accessory box 10 may be required if a smaller volume of accessories is shipped with the base component.

Referring now to FIG. 6, the packaging system according to the present invention also includes a second primary box 61. Second primary box is sized to snugly receive accessory box 10 in its expanded configuration (as shown in FIG. 2) along with a base component in area B. Area B in FIG. 6 is the same as area B in FIG. 5 and is again shown within dashed box 52. Similarly, the first accessory volume is shown at A defined between first side 11 and extension side 12 of accessory box 10. However, since accessory box 10 is in its expanded configuration, extension members 21, 22, and 23 each extend outwardly from extension side 12 of accessory box 10 (this extension member position is shown in FIG. 2). In this position, the extension members associated with accessory box 10 have the effect of spacing the remainder of the accessory box from a wall 62 of second primary box 61. The volume between extension side 12 and wall 62 of second primary box 61 defines an additional or expanded accessory volume E for receiving additional accessories to be shipped together with the base component. In order to accommodate both the base component and accessory box 10 in its expanded configuration, second primary box 61 must be larger than first primary box 51 by approximately the expanded accessory volume E.

FIG. 7 shows the preferred second retainer devices 71 associated with the second primary box 61 for helping to retain the extension members 21, 22, and 23 in their extended position both while accessory box 10 is being filled in second primary box 61 and during shipping of the completed package. The preferred second retainer devices 71 comprise slots formed in wall 62 of second primary box 61. Each second retainer device/slot 71 corresponds to one of the first retainer devices/tabs 25 formed at the distal end of the respective accessory box extension members 21, 22, and 23. When accessory box 10 in its expanded configuration is received in second primary box 61 as shown in FIG. 6, each first retainer device/tab 25 is received in a respective one of the second retainer devices/slots 71. This cooperation between the tabs and slots combined with the snug fit between the received base component in volume B and accessory box 10 holds the accessory box in the proper position illustrated in FIG. 6.

FIGS. 5 and 6 are necessarily diagrammatic and thus show a separation between, for example, the dashed box 52 and first primary box 51 in FIG. 5. A similar separation is shown between the dashed box 52 and second primary box 61 in FIG. 6, and between accessory box 10 and the respective primary box 51 and 61 in the respective figure. These separations are shown only to clearly distinguish the various elements and are not intended to imply the presence of gaps between the various elements. In fact, the various elements within primary box 51 and 61 are snugly received without gaps which would allow the elements to slide back and forth within the respective primary box during shipping.

Figure 8:
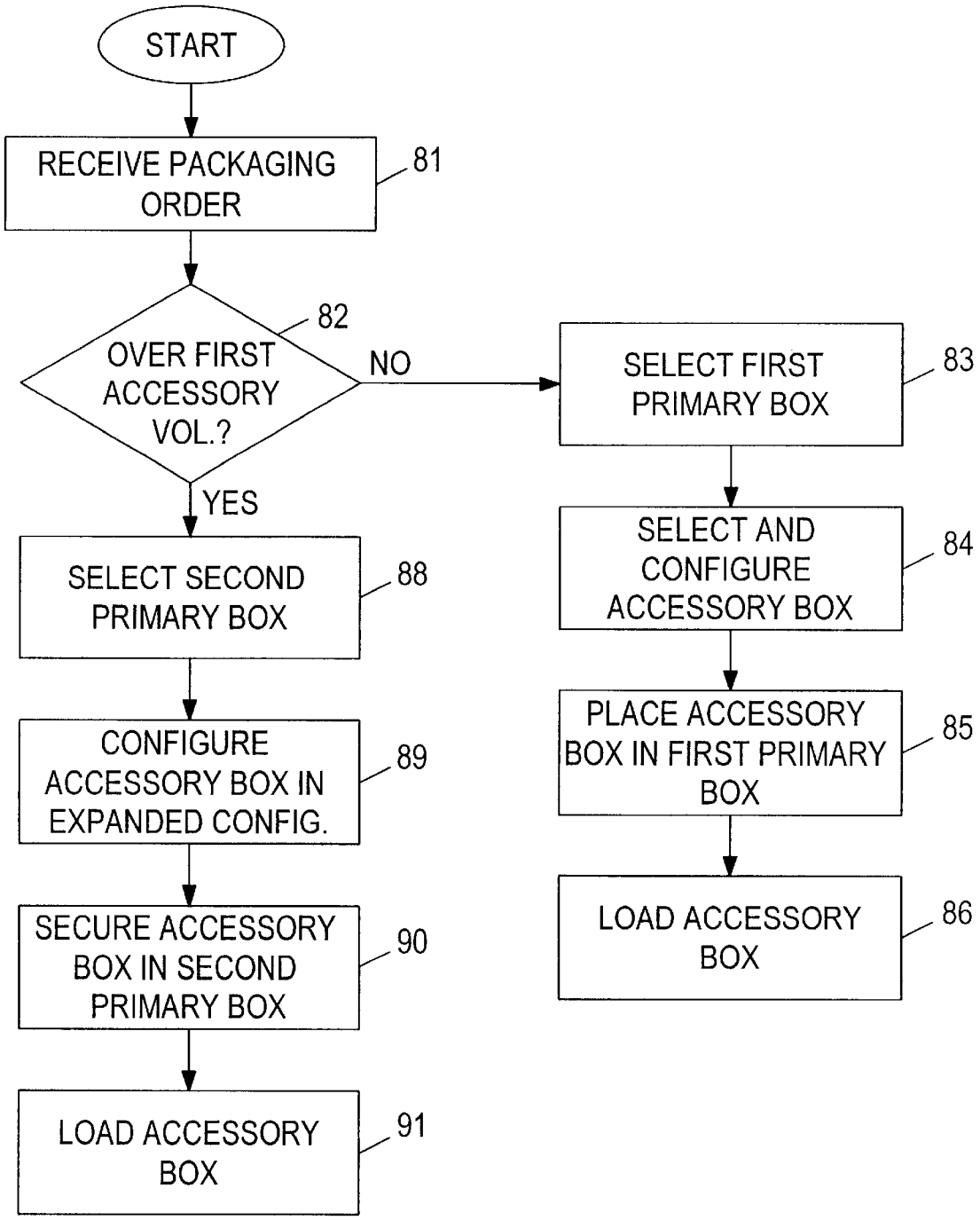
FIG. 8 is a flow chart showing the method steps according to the present packaging method.

The packaging method according to the present invention may now be described with reference to the flow chart of FIG. 8 and with reference to the earlier described figures. Depending upon a particular customer order received at process block 81, the method includes determining whether the volume or quantity of accessories to be shipped with the particular base component is such that all of the accessories cannot be accommodated within the first or regular accessory volume (A in FIG. 5). This decision step is shown at decision block 82. If the volume of accessories is such that the accessories can be contained in the first accessory volume A, the method includes selecting the first primary box 51 from a store of such boxes as shown at process block 83. As shown at block 84, the method next includes selecting one of the expandable accessory boxes 10 from the store of such boxes and configuring the accessory box in its retracted position. The accessory box 10 may then be placed in first primary box 51 along with the base component as shown at process block 85 and then loaded with the designated accessories as shown at block 86.

If the volume of accessories to be shipped with the particular base component is such that the accessories cannot be properly contained in the first accessory volume (A in FIG. 5) as determined at decision block 82, the method includes selecting the second primary box 61 from the store of second primary boxes as indicated at process block 88. The method then includes selecting the accessory box 10 from the store of those boxes and configuring the accessory box 10 in its expanded configuration as shown at process block 89. Configuring accessory box 10 in the expanded configuration requires extending the extension members to their extended position as shown in FIG. 2. Finally, the method includes securing accessory box 10 (in the expanded configuration) in second primary box 61 as indicated at process block 90 in FIG. 8, and then loading accessories into the available accessory volume (accessory volumes A and E) as shown at process block 91. With the preferred form of the invention shown in FIGS. 1 and 2, the step of securing accessory box 10 in the second primary box comprises inserting the first retainer device/tabs 25 in the respective second retainer devices/slots 71 associated with wall 62 of second primary accessory box 61.

The above described preferred embodiments are intended to illustrate the principles of the invention, but not to limit the scope of the invention. Various other embodiments and modifications to these preferred embodiments may be made by those skilled in the art without departing from the scope of the following claims.

What is claimed is:

1. A packaging system for electronic equipment and related accessories to be shipped together, the packaging system including:

(a) an expandable accessory box positionable alternatively in a retracted configuration or an expanded configuration;

(b) a first primary box having a product space sufficient for snugly receiving a system component assembly and the accessory box in the retracted configuration;

(c) a second primary box having a product space sufficient for snugly receiving the system component assembly and the accessory box in the expanded configuration;

(d) first retainer devices included on the expandable accessory box; and (e) second retainer devices included in the second primary box at an end of the second primary box adapted to receive the accessory box in the expanded configuration, the second retainer devices for cooperating with the first retainer devices to hold the accessory box in the expanded configuration in the second primary box.

2. The packaging system of claim 1 wherein the expandable accessory box includes:

(a) a first side and an extension side spaced apart from each other to define a first accessory box volume; and (b) a number of extension members connected to the accessory box and positionable alternatively in an extended position which corresponds to the expanded configuration and a retracted position which corresponds to the retracted configuration, the extension members extending outwardly from the extension side when in the extended position.

3. The packaging system of claim 2 wherein the first retainer devices each include a tab extending from a distal end of a respective of the extension members.

4. The packaging system of claim 3 wherein the second retainer devices each include a slot located on a side of the second primary box and having a size and shape sufficient for operably receiving a respective one of the tabs.

5. The packaging system of claim 2 wherein the extension members are made from corrugated board material in which the flutes of the corrugated material extend generally parallel to a longitudinal axis of the respective extension member.

6. The packaging system of claim 5 wherein the extension members are cut from material making up the extension side of the expandable accessory box.

7. The packaging system of claim 6 wherein at least one extension member includes a score line at a proximal end thereof.

8. An accessory box for use in packaging accessories together in a primary box with an electronic system component, the accessory box including:

(a) a first side and an extension side spaced apart from each other to define a first accessory box volume, with an access opening extending between the first side and the extension side on a top side of the accessory box (b) a number of extension members connected to the accessory box and positionable alternatively in an extended position or a retracted position, the extension members extending outwardly from the extension side when in the extended position; and (c) a first retainer device connected to at lease one of the extension members at a distal end of the respective extension member, the retainer device including a tab extending from the distal end of the respective extension member, the respective tab having a length along the distal end of the respective extension member less than the length of the distal end of the respective extension member and being adapted to cooperate with a second retainer device on the primary box to hold the respective extension member in the extended position.

9. The accessory box of claim 8 wherein the extension members are each made from corrugated board material in which the flutes of the corrugated material extend generally parallel to a longitudinal axis of the respective extension member.

10. The accessory box of claim 9 wherein the extension members are cut from material making up the extension side of the accessory box.

11. The accessory box of claim 10 wherein at least one extension member includes a score line at a proximal end thereof.

12. The accessory box of claim 8 further including:

(a) a first extension member have a proximal end connected to a first end of the accessory box; and (b) a second extension member having a proximal end connected to a second end of the accessory box opposite the first end of the accessory box; and (c) wherein the first extension member and the second extension member each include a respective first retainer device including a tab extending from the distal end of the respective extension member, the respective tab having a length along the distal end of the respective extension member less than the length of the distal end of the respective extension member and being adapted to cooperate with a respective second retainer device on the primary box to hold the respective extension member in the extended position.

13. The accessory box of claim 12 further including a third extension member connected to the accessory box at a location between the first and second ends of the accessory box, and wherein the third extension member includes a respective first retainer device including a tab extending from the distal end of the respective extension member, the tab having a length along the distal end of the respective extension member less than the length of the distal end of the respective extension member and being adapted to cooperate with a respective second retainer device on the primary box to hold the respective extension member in the extended position.

* * * * *